US008196972B2

(12) United States Patent
Lutzke

(10) Patent No.: US 8,196,972 B2
(45) Date of Patent: Jun. 12, 2012

(54) LATCHING DEVICE FOR A SPRING-TYPE DRIVE

(75) Inventor: Gunnar Lutzke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 1083 days.

(21) Appl. No.: 12/090,429

(22) PCT Filed: Oct. 24, 2006

(86) PCT No.: PCT/EP2006/067683

§ 371 (c)(1),
(2), (4) Date: Apr. 16, 2008

(87) PCT Pub. No.: WO2007/048774

PCT Pub. Date: May 3, 2007

(65) Prior Publication Data

US 2008/0202910 A1 Aug. 28, 2008

(30) Foreign Application Priority Data

Oct. 25, 2005 (DE) ..... 10 2005 052 182

(51) Int. Cl.
*E05C 1/06* (2006.01)
*E05C 19/00* (2006.01)

(52) U.S. Cl. ..... 292/140; 292/1; 292/166; 292/DIG. 37; 292/DIG. 61

(58) Field of Classification Search ..... 200/400, 200/318, 318.1, 318.2, 321, 325, 327; 292/1, 292/57, 58, 60, 137, 163, 166–169, 169.13, 292/138, 139, 140, 145, 150, 173–175, 177, 292/178, 143, 179, 302, DIG. 37, DIG. 46, 292/DIG. 52, DIG. 61; 52/241, 243.1
See application file for complete search history.

(56) References Cited

U.S. PATENT DOCUMENTS

| | | | | | |
|---|---|---|---|---|---|
| 252,310 | A | * | 1/1882 | Goebel | 292/140 |
| 1,492,327 | A | * | 4/1924 | Keppler | 52/243.1 |
| 1,712,236 | A | * | 5/1929 | Stuart et al. | 292/168 |
| 2,136,662 | A | * | 11/1938 | Anderson | 292/64 |
| 2,252,591 | A | * | 8/1941 | Anderson | 292/63 |
| 2,547,546 | A | * | 4/1951 | Stulpin et al. | 292/166 |

(Continued)

FOREIGN PATENT DOCUMENTS

CH 530710 A 11/1972

(Continued)

*Primary Examiner* — Carlos Lugo
*Assistant Examiner* — Alyson M Merlino
(74) *Attorney, Agent, or Firm* — Laurence A. Greenberg; Werner H. Stemer; Ralph E. Locher

(57) ABSTRACT

A latching device has a resetting device, a triggering device for producing a triggering force which acts in a first direction, a compression element, and an upper and a lower supporting element which, in the latched state, are arranged one above the other in a housing and are connected to each other by at least one coupler such that they are at a distance from each other, and which, in the latched state, are acted upon, to provide a spring-type drive, by a compressive force applied along a line of action via the compression element. The lower supporting element, loaded by the compressive force in the latched state, is deflected against a stop and is held in that position. The paths of movement of the upper and of the lower supporting element are defined by the housing by way of guides. The path of movement for the lower supporting element runs substantially perpendicular to the path of movement of the upper supporting element.

9 Claims, 1 Drawing Sheet

U.S. PATENT DOCUMENTS 3,768,052 A 10/1973 Bühler et al.
4,095,827 A * 6/1978 Stavenau ..... 292/65
4,445,394 A 5/1984 Yapp et al.
5,834,717 A * 11/1998 Neumeyer et al. ..... 200/17 R
6,108,989 A * 8/2000 Kordes et al. ..... 52/243.1
7,234,735 B2 * 6/2007 Harada ..... 292/170

FOREIGN PATENT DOCUMENTS

DE 1108301 B 6/1961
GB 2145461 A * 3/1985

* cited by examiner

LATCHING DEVICE FOR A SPRING-TYPE DRIVE

BACKGROUND OF THE INVENTION

1. Field of the Invention

The invention relates to a latching device having a resetting device, having a triggering device, having a compression element and having supporting elements which are arranged one above the other in a housing and which, in the latched state, are acted upon with a compressive force applied via a compression element, to provide a spring-type drive.

2. PRIOR ART

Latching devices of this type for spring-type drives are employed, for example, in high-voltage circuit breakers. The storage spring contained in a spring-type drive can be kept in a stressed state by a latching device. By means of a latching device, a comparatively large amount of stored energy can be released from the stressed storage spring in a controlled manner. In order to release the stored energy, the latching device has a triggering device, which operates with an amount of energy that is small as compared with the energy to be released.

It has already been proposed to use the rolling support principle in a latching device. In this principle, four rollers are arranged above one another, the two intermediate rollers not being arranged in alignment with the two outer rollers. A compressive force is introduced from above by a supporting latch via a compression element and is transmitted to the uppermost roller, so that it is transmitted in a supporting manner to the lowest roller via the two intermediate rollers.

During the triggering process, the two intermediate rollers are displaced counter to their alignment deviation by a triggering device until the result is an alignment deviation in the opposite direction. Following a triggering process, the two intermediate rollers are at a distance from a holding position and the supporting action is canceled; the two intermediate rollers are forced out sideways and free a path for the compression element. The supporting latch bearing on the compression element is thus able to cover a predefined travel and the previously stressed storage spring is released.

However, in the case of this triggering principle, the result is that the stroke of the compression element can only be as great as the magnitude of the diameters of the two inner rollers. In the event of a desired enlargement of the stroke of the compression element, the diameters of at least the inner rollers would consequently have to be enlarged, which likewise would result in an enlargement of the overall latching device and therefore entails an increased requirement for materials and space.

Furthermore, the document DE 11 08 301 A discloses a contact arrangement for electric switches which comprises a main switching piece and a circuit-breaking switching piece comprising a plurality of individual switching pieces connected in parallel.

BRIEF SUMMARY OF THE INVENTION

The invention is based on the object of providing a latching device for a spring-type drive which can reliably hold high forces and, at a triggering time, releases the force from a storage spring as quickly as possible. In this case, the energy needed for the triggering must be as low as possible.

This object is achieved in by a latching device having a resetting device, having a triggering device for the production of a triggering force acting in a first direction, having a compression element and having an upper and a lower supporting element which are arranged one above the other in a housing in the latched state and which are connected to each other by at least one coupling rod in such a way that they are at a distance from each other and which, in the latched state, are acted on with a compressive force applied along a line of action via the compression element, to provide a spring-type drive, in the latched state the lower supporting element being deflected against a stop under the loading of the compressive force and being held in this position, and in which movement paths of the upper and the lower supporting element are defined by guides in the housing, the movement path for the lower supporting element running substantially perpendicular to the movement path of the upper supporting element, and the triggering force effected by the triggering device moving the lower supporting element away from the stop, and in which, when the triggering device is actuated, it being possible for the lower supporting element to be displaced perpendicular to the line of action of the compressive force applied to the upper supporting element by the compression element.

Advantageous refinements are specified in the following disclosure.

The advantages that can be achieved with the invention consist in particular in the fact that, with a small triggering stroke, a small triggering force and with a low mass of the moving parts, a greater stroke of the compression element is made possible. This arrangement additionally permits a rapid response upon the occurrence of a triggering command for a spring-type drive. Furthermore, the expenditure on materials and fabrication, as compared with existing solutions, is lower. For instance, the stop can be formed in such a way that a recess is provided in the first guide in the region of the first guide located immediately under the direction of operation of the compression element, so that the lower supporting element can be deflected in the operating direction and is held stably there in a recess acting appropriately as a stop. However, the stop can also be located in an alternative position.

Provision can advantageously be made for the resetting device to be forced in the direction of the lower supporting element by a spring.

According to one refinement, either the resetting device can be forced by a compression spring against the lower supporting element and therefore against the triggering force that can be produced by the triggering device, or it is configured in such a way that the lower supporting element can be pulled counter to the first direction by means of a tension spring.

Furthermore, provision can advantageously be made for the resetting device to be guided along the first direction in the housing.

As a result of guiding the resetting device in the housing, further auxiliary devices are rendered superfluous. As a result, a compact housing is made possible, which also permits mechanical protection of the resetting device. In order to permit the mobility of the lower supporting element, the resetting device is able to move both forward and backward along the first direction.

Furthermore, provision can advantageously be made for the resetting device and the lower supporting element to be moved in the direction of the triggering device by a helical spring acting on the resetting device.

Furthermore, provision can advantageously be made for the guides each to have a linear course.

Linear guides can be fabricated inexpensively. Furthermore, low frictional forces occur in linear guides.

In a further refinement, provision can advantageously be made for at least one supporting element to be guided laterally in slot tracks integrated in the housing.

Thus, in this refinement, no arrangement of separate guide elements for the at least one supporting element is necessary.

Advantageously, in the triggered state, the stop point of the upper supporting element with the coupling rod can be located above the line of action of the resetting force of the resetting device.

The effect of this is that, when the lower supporting element is acted on by the force effected by the resetting device, displacement of the upper supporting element in the direction of the compression element and the supporting latch is possible.

A further advantageous refinement can provide for the supporting elements guided in slot tracks in the housing to project sideways out of the housing, at least on one side, and for the coupling rod to be fixed to their projecting ends.

Connecting the supporting elements at the side permits simplified mounting of the latching device. Thus, the supporting elements can be introduced into the slot tracks and connected to the coupling rod in a straightforward way outside the housing. In this case, provision can be made for the supporting elements to be connected to the coupling rod in an angularly rigid manner. However, provision can also be made for the supporting elements to be connected to the coupling rod such that they can rotate. By means of the rotatable mounting of the supporting elements, the friction during a movement of the supporting elements in the slot tracks is reduced. As a result, the necessary forces which are required to move the individual movable elements are reduced.

In an advantageous way, the length of the coupling rod can be set variably.

This ability to vary the length of the coupling rod has the effect of adjustability of the stroke of the compression element. In the latched state, a force is applied to the supporting elements and the coupling rod via the compression element. In order to unlatch the supporting latch and therefore to release the storage spring of a spring-type drive, a specific stroke is needed by the compression element and consequently by the supporting latch. Different spring-type drives need different strokes of the compression element in order to release the supporting latch. A change in the length of the coupling rod makes it possible to use the latching device for different spring-type drives with different requirements with regard to the stroke of the compression element and/or the supporting latch. The end positions of the lower supporting element can advantageously be adapted appropriately.

In an alternative refinement, the length of the compression element can be varied. This has the advantage that, in the event of a change in the length of the coupling rod, the supporting latch can nevertheless be kept in the same position if the compression element is lengthened, for example as a countermeasure in the event of shortening the coupling rod.

A variation in the stroke of the compression element can likewise be effected advantageously by it being possible to vary the length of the displacement travel of at least one supporting element.

This can be achieved in an advantageous way by the displacement travel of the lower supporting element being limited by the resetting device.

An exemplary embodiment of the invention is illustrated schematically in the drawing and will be described in more detail below.

DESCRIPTION OF THE INVENTION

Figure 1:
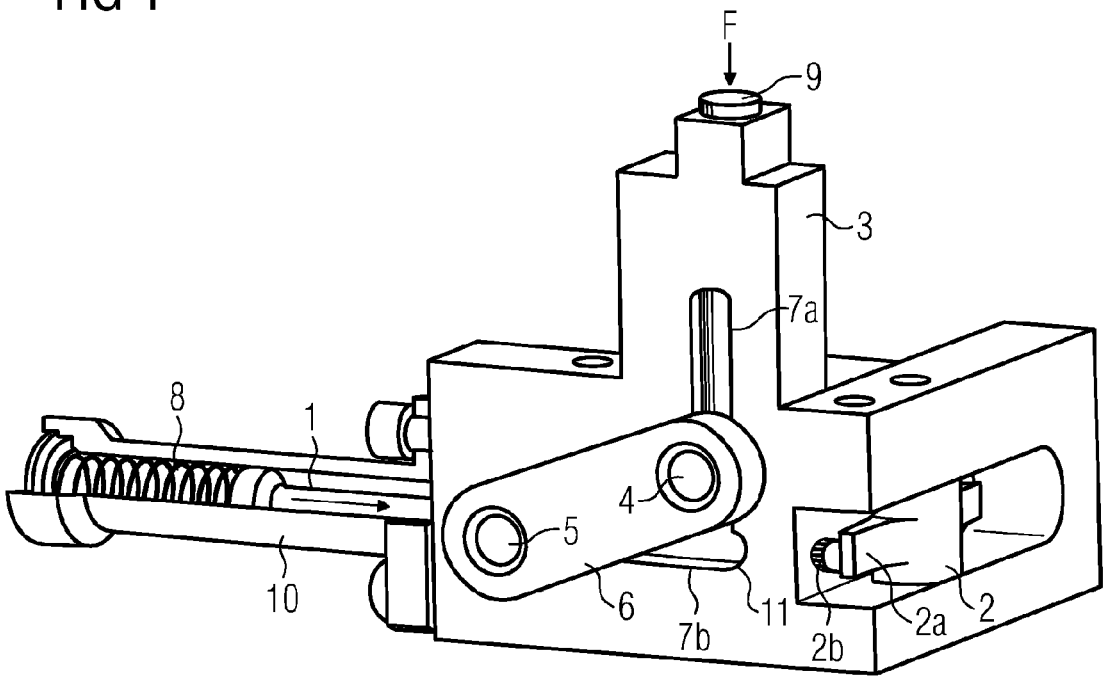
FIG. 1 shows the latching device in the triggered state and FIG. 2 shows the latching device in the latched state.

By using the latching device illustrated in the triggered state in FIG. 1, its fundamental structure will be described first. The latching device has a housing 3, which serves as a chassis to accommodate further fittings. The housing 3 is, for example, a metallic casting or milled part. Arranged on the housing 3 is a resetting device 1, which is arranged in the interior of a sleeve 10 such that it can be displaced along the sleeve 10. On the side of the housing 3 facing away from the sleeve 10 there is arranged a triggering device 2. The triggering device 2 has a cam 2*a*. The triggering device 2 is mounted such that it can rotate, so that the cam 2*a* can effect a translational movement of a disengaging pin 2*b* in the event of a rotational movement of the triggering device 2. The disengaging pin 2*b* can be moved back and forth substantially in the same direction as the resetting device 1.

Furthermore, the housing 3 has a first and a second guide 7*a*, 7*b*. The guides 7*a*, 7*b* are introduced into the housing 3 in the form of continuous slot tracks. The first guide 7*a* is assigned to an upper supporting element 4. The second guide 7*b* is assigned to a lower supporting element 5. The supporting elements 4, 5 in each case slide in one of the two guides 7*a*, 7*b*. The guides 7*a*, 7*b* are arranged in relation to each other in such a way that they are perpendicular to each other. The slots which form the guides 7*a*, 7*b* meet each other in the form of an L. However, the guides can also be designed separately from each other. By means of the guides 7*a*, 7*b*, movement paths running along straight lines are defined for the supporting elements 4, 5. The supporting elements 4, 5 are arranged at a distance from each other. They are each formed in the shape of rolls and project beyond surfaces of the housing 3. In order to fix the distance of the supporting elements 4, 5 from each other, use is made of a coupling rod 6. The coupling rod 6 is formed in the shape of a fishplate, which is arranged parallel to the surface beyond which the supporting elements 4, 5 project. Advantageously, an identical configuration of the coupling rod can be provided on the hidden side of the exemplary configuration illustrated in FIG. 1, so that symmetrical guidance of the supporting elements 4, 5 is ensured. The supporting elements 4, 5 can be connected to the coupling rod 6 such that they can rotate. As a result, the friction during a movement of the supporting elements 4, 5 in the guides 7*a*, 7*b* can be reduced. A compression element 9 is formed in the shape of a pin, the pin longitudinal axis being oriented parallel to the first guide 7*a*, in such a way that the pin 9 projects into the first guide 7*a* and can enter into a connection to the upper supporting element 4 in order to exert a compressive force F on the upper supporting element 4.

The guides 7*a*, 7*b* are arranged perpendicular to each other, so that an L-shape is produced. The guides 7*a*, 7*b* themselves are in each case configured substantially linearly. In the region of the point of intersection of the two guides 7*a*, 7*b*, the second guide is machined out slightly beyond an edge of the body of the first guide 7*a* in the direction of the disengaging pin 2*b* on the triggering device 2 and forms a stop 11 there. This stop 11 is used to form an overtravel in order to effect a stable position of the supporting elements 4, 5 in the latched state.

A transfer of the latching device from its triggered state to a latched state is to be described below. Driven by a stressed spring 8, which is supported on a bottom region of the sleeve 10 facing away from the housing 3, the resetting device 1 is driven in the direction of the lower supporting element 5, toward the latter. In the process, the lower supporting element 5, guided by the second guide 7*b*, moves on a linear path in the direction of the disengaging pin 2*b* of the triggering device 2. Since the lower supporting element 5 is connected to the upper supporting element 4 via the coupling rod 6, the upper supporting element 5 is carried along with it and moves in the first guide track 7*a* in the direction of the compression element 9. In the process, on account of the position of the compression element 9 in the movement path of the upper supporting element 4, the compression element 9 is moved partly out of the housing 3. In the process, the compression element 9 applies a compressive force F with a direction of action working in the direction of the upper supporting element. At the free end of the compression element 9, it is possible for example for a supporting latch of a spring-type drive to be arranged. Via this supporting latch, a stressed storage spring of a spring-type drive can be blocked. The supporting latch can be reset via the compression element 9.

When it reaches the region of the first guide 7*a* located directly under the direction of action of the compression element 9, the coupling rod 6 with the two supporting elements 4, 5 assumes an unstable position. At this instant, the other supporting element 4 is at the greatest distance from the second guide 7*b*. When the movement of the lower supporting element 5 is continued in the direction of the stop 11, a slight reverse movement of the upper supporting element 4 in the direction of the second guide 7*b* takes place, so that, after it reaches the stop 11, the coupling rod 6 with the two supporting elements assumes a stable position. Given compressive loading of the compression element 9, a latched position of the latching device can thus be ensured lastingly. This compressive loading is transmitted to the compression element 9 by a spring element, for example.

In order to position the lower supporting element 5 in a dead-center position, a stop can be provided in one of the guides, which permits a deflection substantially transversely with respect to one of the guide tracks. The stop can, for example, be formed on the end of the second guide 7*b* assigned to the lower supporting element 5, facing the triggering device 2, so that the stop 11 is oriented transversely with respect to the first guide 7*a*, in which the upper supporting element 4 can be moved. In the event of an L-shaped arrangement of the two guides 7*a*, 7*b*, this can be a milled-out portion, which permits an overtravel of the lower supporting element 5 and, under the loading of the compressive force, is kept in this dead-center position produced in this way. Alternatively or additionally, provision can also be made for the stop to be located at the end of the first guide 7*a* assigned to the upper supporting element 4, which means that the stop is then arranged transversely with respect to the second guide 7*b* that is assigned to the lower supporting element 5. In this case, the lower supporting element is also kept stably in a dead-center position because of the compressive force that acts. A sideways movement out of the stop formed in this way can be carried out in the same way as described below.

Figure 2:
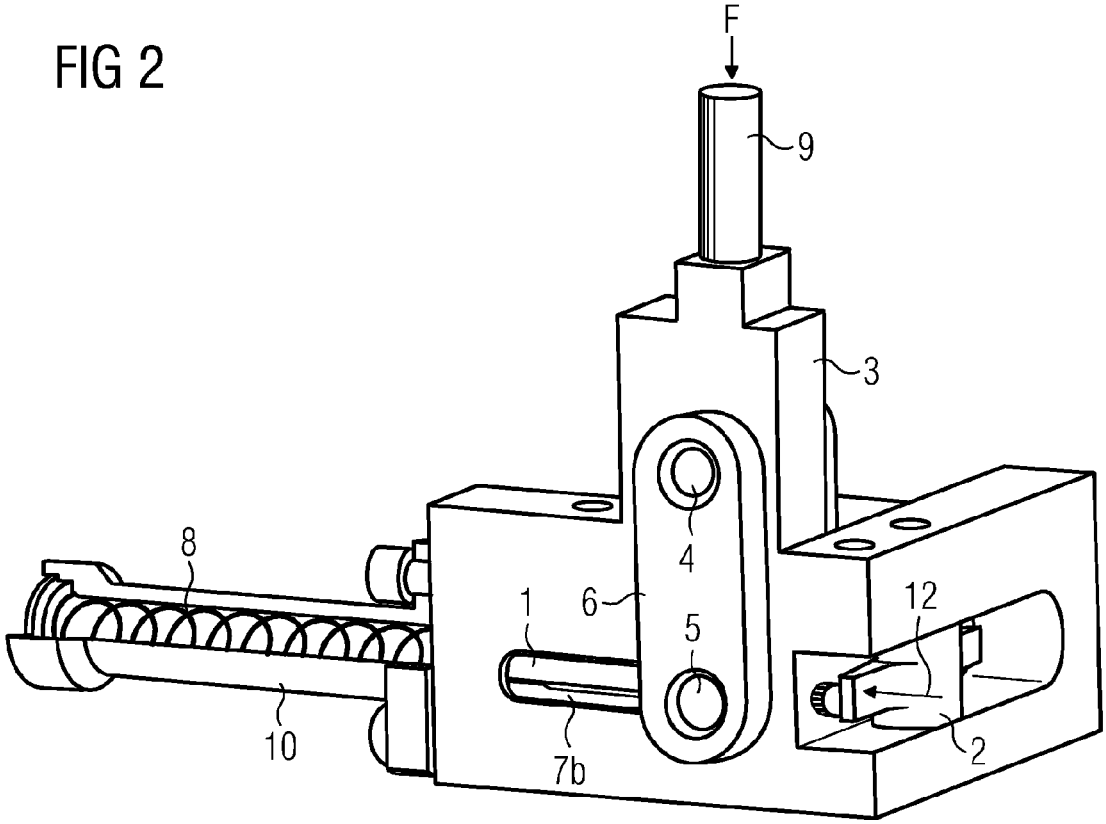

After reaching the latched position (see FIG. 2), the spring 8 is now in an unstressed state. The resetting device 1 could be moved back into the position shown in FIG. 1, since the coupling rod 6 with the supporting elements is supported on the stop 11 and is thus positioned stably.

In order to trigger the latching device and to transfer the latching device from the latched to the triggered state, a rotational movement of the triggering device 2 can be produced, which means that the cam 2*a* forces the disengaging pin 2*b* in a first direction 12. The cam 2*a*, which was previously located behind the stop 11 on which the lower supporting element 5 was supported, leaves this position and forces the lower supporting element 5 out of the stop in the first direction 12, applying a triggering force. Here, an overtravel is produced and, via the coupling rod 6, the upper supporting element 4 is moved counter to the compressive force applied by the compression element 9. Once the stop points of coupling rod 6 and the respective supporting elements 4, 5 are located on the line of action of the compressive force acting on the compression element 9, an unstable position has been reached. With the further progressive movement of the disengaging pin 2*b*, the unstable position is passed over and, driven by the compressive force F applied to the compression element 9, the upper supporting element 4 is pressed in the direction of the second guide 7*b*. In the process, the lower supporting element 5 intersects the line of action of the compressive force F. As a result of the positive guidance of the lower supporting element 5 within the second guide 7*b* and the coupling rod 6 between the supporting elements 4, 5, the lower supporting element 5 is moved in the first direction 12. If the resetting device 1 has not yet been guided back into its triggered position, this is now displaced counter to the action of force from the spring 8. Because of the spacing of the upper supporting element 4 and the lower supporting element 5 via the coupling rod 6, the upper supporting element 4 is prevented from sliding into the region of the first guide 7*a*. By means of a variation in the length of the coupling rod 6, the stroke of the compression element 9 effected by the movement of the upper supporting element 4 can be varied.

The invention claimed is:

1. A latching device for a spring drive, comprising:

a housing, a resetting device, and a compression element;

an upper supporting element and a lower supporting element, disposed one above the other in said housing in a latched state, and a coupler connecting said upper and lower supporting elements to one another at a spacing distance from one another;

wherein, in the latched state, said upper and lower supporting elements are subjected to a compressive force provided externally from the latching device, the compressive force being applied along a line of action via said compression element, and said lower supporting element, in the latched state, is moved against a stop under the loading of the compressive force;

said housing having guides defining respective movement paths of said upper and the lower supporting elements, with a movement path of said lower supporting element running substantially perpendicular to a movement path of said upper supporting element;

a triggering device for producing a triggering force acting in a first direction for moving said lower supporting element away from said stop;

wherein, when said triggering device is actuated, said lower supporting element is displaced perpendicular to the line of action of the compressive force applied to said upper supporting element by said compression element and through the line of action of the compressive force applied to said upper supporting element by said compression element.

2. The latching device according to claim 1, which comprises a spring configured to force said resetting device in a direction of said lower supporting element.

3. The latching device according to claim 1, wherein said resetting device is guided along the first direction in said housing.

4. The latching device according to claim 1, which comprises a helical spring acting on said resetting device for moving said resetting device and said lower supporting element in a direction of said triggering device.

5. The latching device according to claim 1, wherein said guides each have a linear course.

6. The latching device according to claim 1, wherein said guides are slot tracks, at least one of said upper and lower supporting elements is guided laterally in said slot tracks integrated in the housing.

7. The latching device according to claim 1, wherein, in a triggered state, a stop point of said upper supporting element with said coupler is located above a line of action of a resetting force of said resetting device.

8. latching device according to claim 1, wherein said guides are slot tracks, said upper and lower supporting elements are guided in said slot tracks formed in said housing and have ends projecting laterally out of said housing, at least on one side thereof, and said coupler is fixed to the ends of said supporting elements projecting out of said housing.

9. The latching device according to claim 1, wherein a length of a displacement travel of said lower supporting element is limited by a constructional configuration of said resetting device.

* * * * *